United States Patent [19]

O'Neill

[11] Patent Number: 4,523,526

[45] Date of Patent: Jun. 18, 1985

[54] HANGING STRAPPED SHELVES

[75] Inventor: Hugh O'Neill, Mississauga, Canada

[73] Assignee: Sling-All Ltd., Mississauga, Canada

[21] Appl. No.: 475,087

[22] Filed: Mar. 14, 1983

[51] Int. Cl.[3] ..... A47B 5/02

[52] U.S. Cl. ..... 108/149; 108/96; 108/111; 211/113; 211/118

[58] Field of Search ..... 108/149, 106, 111, 96; 211/118, 117, 113; 248/250, 235, 328, 327

[56] References Cited

U.S. PATENT DOCUMENTS

| | | | |
|---|---|---|---|
| 293,894 | 2/1884 | Loomis | 108/111 |
| 894,706 | 7/1908 | Schubert | 108/111 |
| 916,785 | 3/1909 | Rowell | 108/106 |
| 2,051,241 | 8/1936 | Biggers | 108/149 |
| 2,091,868 | 8/1937 | Mattson | 108/149 |
| 2,206,753 | 7/1940 | Roth | 108/111 |
| 3,025,970 | 3/1962 | Ostrom | 108/96 |
| 4,129,080 | 12/1978 | Vall | 108/149 |
| 4,187,787 | 2/1980 | Nakatsu | 108/149 |
| 4,244,301 | 1/1981 | Nakatsu | 108/149 |
| 4,295,432 | 10/1981 | Hulke | 108/111 |

FOREIGN PATENT DOCUMENTS

| | | | |
|---|---|---|---|
| 396442 | 4/1909 | France | 108/149 |
| 608482 | 7/1926 | France | 108/149 |
| 1294347 | 4/1962 | France | 108/111 |

*Primary Examiner*—William E. Lyddane
*Assistant Examiner*—Mark W. Binder
*Attorney, Agent, or Firm*—Donald E. Hewson

[57] ABSTRACT

Shelves are disclosed having slots cut in their ends, into which are threaded straps comprising loops of webbing. Top-straps are for supporting the topmost shelf from a wall, and shelf-straps are for supporting a shelf from a shelf above. The modularity of the pre-formed loops permits a very versatile system. Long shelves are also shown with T-slots by which the shelf can be supported intermediately.

6 Claims, 9 Drawing Figures

HANGING STRAPPED SHELVES

This invention relates to shelf assemblies, of the kind in which the shelves are supported on flexible straps that can be hung from mounting points on a wall or ceiling.

BACKGROUND TO THE INVENTION

One of the problems of a strap-supported shelving system is that of ensuring that the shelves hang level, both front-to-back and end-to-end. Another problem is that of ensuring that the shelves, once set, cannot slip with respect to the straps. Neat, attractive appearance and inexpensive construction are other aspects that must be provided for.

BRIEF DESCIPTION OF THE INVENTION

The invention seeks to overcome these difficulties by the use of pre-formed loops of webbing material for the straps, and by the provision of slots formed in the ends of the individual shelves. The loop of webbing may be threaded through the slots in one shelf, and hang down and be threaded through the slots in the shelf below: the lower shelf then takes its support from the upper shelf. The loop is pre-formed by the manufacturer to be the same size as other loops, so that it is a simple matter to ensure levelness and evenness of spacing. The slots are cut wide enough that another loop of webbing may be threaded through the slots in the lower of the shelves mentioned, by which another shelf may be hung lower still. The manufacturer thus provides a modular system of shelving which does not involve his having to provide many different sizes of components, each to depend on how the user wants to set up the shelves: instead, the loops and shelves can be all the same, and only the quantity is dependent on the user's requirements. Indeed, it is a simple matter for the user to add other shelves to an already assembled set. To hang the topmost shelf from a wall or ceiling an eyelet may be provided, either in all the loops, or in a variation of loop additional to the loop on which the shelves are supported from other shelves.

PRIOR ART

The prior art does not show the use of pre-formed loops of webbing to achieve modularity, versatility, stability, and attractiveness. U.S. Pat. No. 4,244,301 (NAKATSU, Jan. 13, 1981), No. 4,187,787 (NAKATSU, Feb. 12, 1980) and No. 2,206,753 (ROTH, July 2, 1940) show the use of cords as straps for hanging shelves. Cords are different from straps in that it is a simple matter for a cord to be crossed over itself, since two portions of a cord may lie alongside each other with no difficulty: webbing cannot neatly be crossed, since its relatively much greater width would make the crossover area look most ungainly. On the other hand, webbing is much more stable than a cord in retaining itself in a slot: a cord can quite easily work sideways out of a slot in that it can roll relative to the slot, whereas webbing in order to move must slip bodily. Thus, the prior art showing cords, in addition to the fact that it does not teach the use of pre-formed loops and slots, also is not applicable to the use of webbing straps whose characteristics, as stated, are rather different.

U.S. Pat. No. 4,129,080 (VALL, Dec. 12, 1978) and No. 4,295,432 (HULKE, Oct. 20, 1981) show webbing. However, in both these cases one length of webbing serves for many shelves, and so a manufacturer needs to know how many shelves the user requires so that he can make a length of webbing accordingly. There is no suggestion of the modular kind of assembly that is possible with the pre-formed loops and slots of the invention. In the prior art, levelness and spacing of the shelves can only be set by tiresome trial-and-error measurements, and the user can hardly add on a further shelf to an already comlplete set, not at least without disrupting the whole set.

Further aspects of the invention will become apparent from the following description of an exemplary embodiment.

Figure 1:
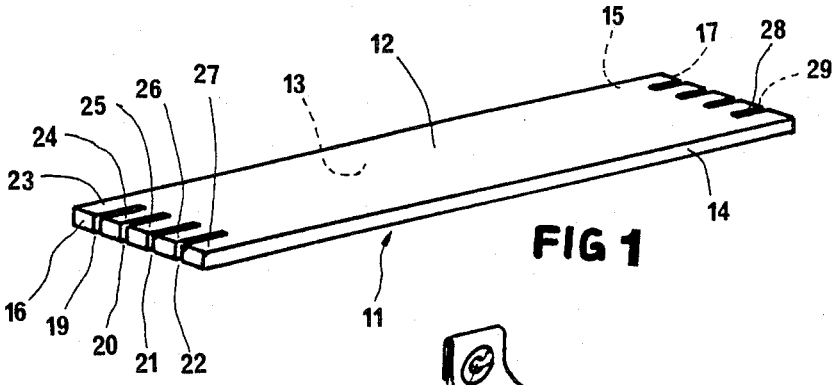
FIG. 1 shows a shelf.

The shelf 11 in FIG. 1 is made of redwood $\frac{3}{4}$ inches thick, $7\frac{1}{4}$ inches wide, and 18 inches long. The shelf 11 has top 12, bottom 13, front 14, back 15, and two end 16, 17 surfaces. Four slots 19, 20, 21, 22 are cut through the shelf in the end associated with the end surface 16, and four more in the end 17. The slots are equi-pitched, in that the five tongues 23, 24, 25, 26 and 27 that are left by the cutting of the slots are all the same width. The shelf 11 is rectangular, and the slots are of uniform width and length. The sides 28, 29 of the slots are flat, straight, parallel to the front 14 and back 15 surfaces and to each other, and at right angles to the top 12 and bottom 13 surfaces, and to the end surface 16.

Figure 2:
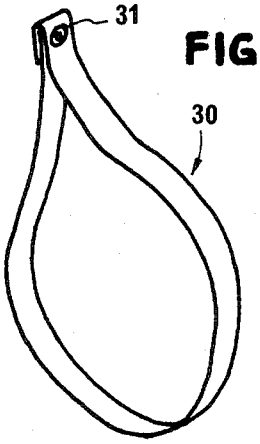
FIG. 2 shows a strap.

FIG. 2 shows a top strap 30, used for supporting an end of a shelf that does not have the end of another shelf directly vertically above it. The top-strap comprises a length of webbing formed into a loop as shown, and secured permanently by means of a riveted eyelet 31.

Figure 3:
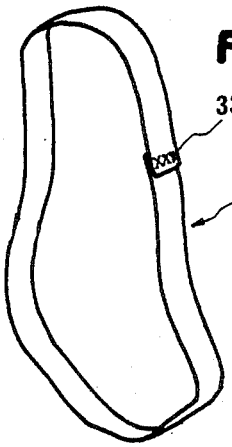
FIG. 3 shows another strap.

FIG. 3 shows a shelf-strap 32, which is used for supporting an end of a shelf that is directly vertically beneath an end of another shelf. The shelf-strap comprises a length of the same webbing as that which was used to make the top-strap 30, again formed into a loop, but this time secured permanently by means of a stitched joint 33.

Each top-strap 30 may be made of the same loop-length as any other top-strap, by the simplest of factory quality control. The same applies to each shelf-strap 32. The top-strap 30 need not be the same length as the shelf-straps 32 since the two kinds of strap will not be used interchangeably.

The webbing is of woven Dacron TM or other polyester. The joint 33 may be trimmed by melting the cut fibres together.

The slots 19, 20, 21, 22 each have a width of about $\frac{1}{8}$ inches. A double thickness of the webbing can be inserted comfortably into a slot of this width. The webbing is $1\frac{1}{2}$ inches wide, and the slots are $1\frac{3}{4}$ inches deep, so the webbing may be placed well in from the extreme end surfaces.

Figure 4:
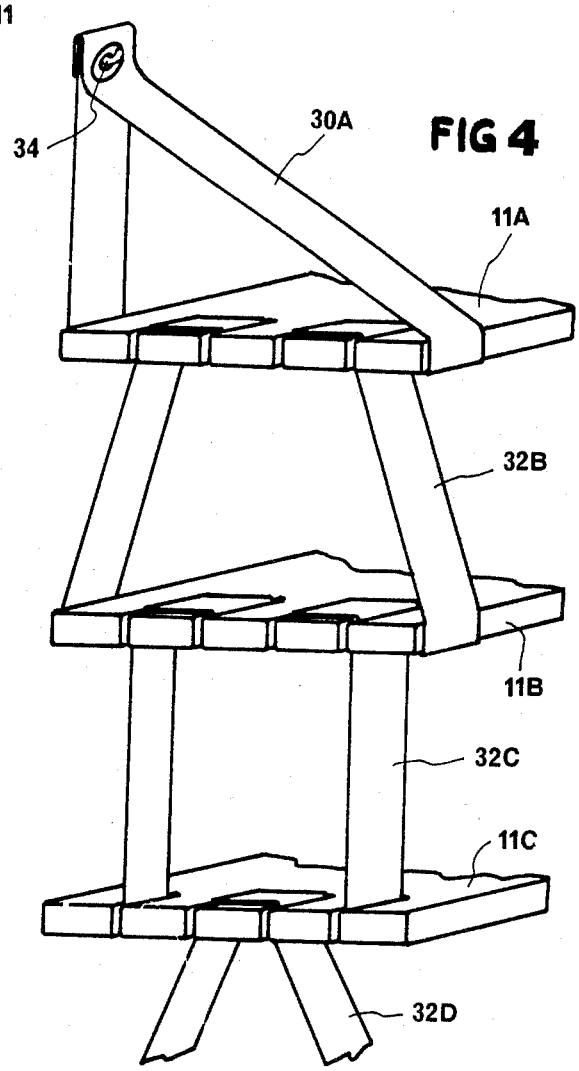
FIG. 4 shows an arrangement of straps and shelves.

In FIG. 4, an assembly of shelves and straps has been made. The top shelf 11A, of course has no shelf above it, so it is supported on top-straps 30A, which are placed over hooks 34 screwed into a wall (not shown). The other shelves, 11B, 11C . . . do have shelves above them, so they are supported on shelf-straps 32B, 32C, 32D . . . .

The manner in which the loops comprising the straps are threaded through the slots 19, 20, 21, 22 in each of the various shelves is illustrated in FIG. 4. In a shelf assembly, an attempt would be made to make each loop have the same configurarion, for uniformity of appearance and to keep the shelves level. The various threading pattern show in FIG. 4 will of course result in slightly different shelf-to-shelf spacings, for a given length of loop 32. The straps can serve not only as supports but also as shelf-stoppers or book-ends. However, different threading patterns are possible, as illustrated.

Figure 5A:
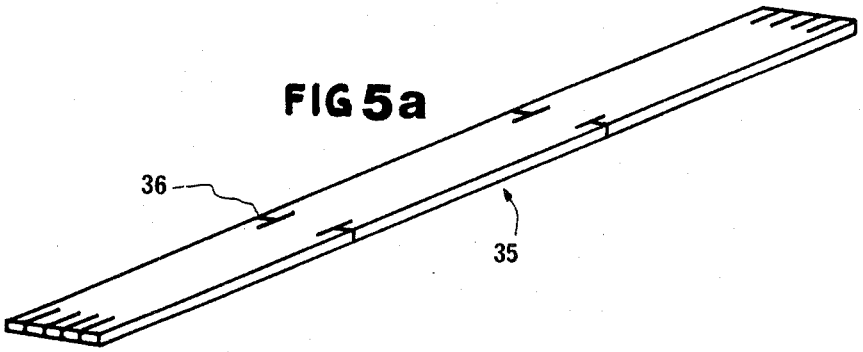
FIGS. 5*a* and 5*b* show long shelves.
Figure 5B:
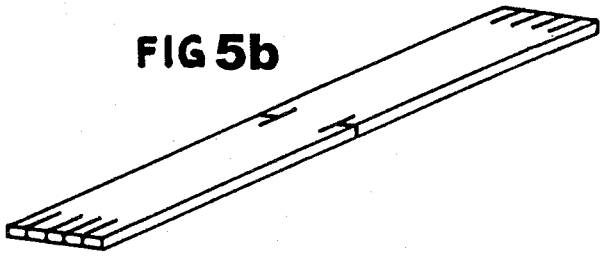
Figure 6A:
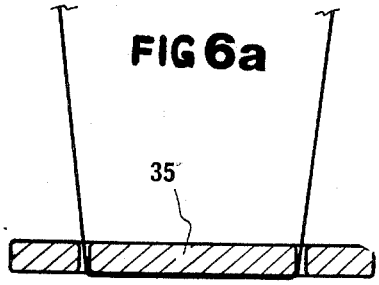
FIGS. 6*a* and 6*b* show other arrangements of straps and shelves.
Figure 6B:
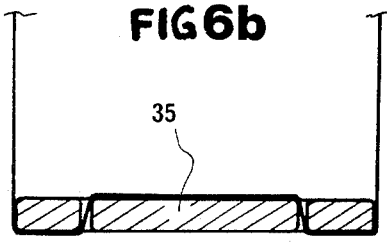

FIG. 5*a* shows a long shelf 35, which is 50 inches long but otherwise similar to the shelf 11. The shelf 35 is nominally three times the length of a shelf 11. The shelf 35 has T-slots 36, the purpose of which is to permit either top-straps 30 or shelf-straps 32 to be used to support the shelf 35 intermediate between its ends. FIG. 5*b* shows another long shelf, this time only nominally twice the length of the shelf 11. FIGS. 6*a* and 6*b* shows two ways in which the straps may be threaded: there is more restriction on the threading patterns than is the case with the four slots.

Figure 7:
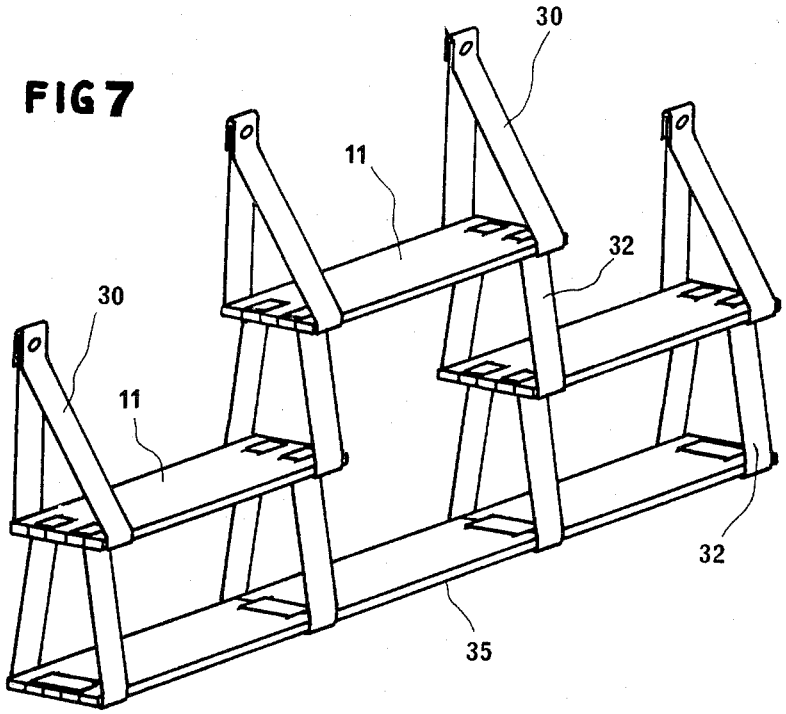
FIG. 7 shows a further arrangement of straps and shelves

Finally, FIG. 7 shows a typical arrangement of shelves and straps that can be made. The benefit of the system of shelving as described and illustrated is that not just the FIG. 7 arrangement but many other attractive arrangements can be achieved with the same basic, simple, units. It is the modularity of the units that gives rise to their versatility. For this reason, it is very easy to display the shelving system for sale: the retailer only needs an outfit comprising the ordinary shelves 11, the double and triple shelves 35, the top straps 30, and the shelf-straps 32. The shelves and straps can be shipped, sold, and taken home by the purchaser all in unassembled form, yet the purchaser buys only items which will be useful to him even if he should completely re-arrange and add to his installation. One or more additional shelves may be hung from an existing shelf arrangement, with no extra hardware being needed. An arrangement may be very easily taken down and remounted in another location. The materials stated are suitable for outdoor as well as indoor use.

What is claimed is:

1. Shelf assembly, comprising:

an upper shelf and a lower shelf, both of rectangular shape;

a left shelf-strap and a right shelf-strap;

where each shelf has respective left and right strap attachment locations;

where the two shelf-straps are formed as substantially identical endless loops of webbing;

where, at each strap attachment location, the shelf is provided with slots which pass right through the shelf from its top surface to its bottom surface;

where the material of the shelf is divided by the slots into separate tongues;

where each shelf-strap is attached to both shelves at respective strap attachment locations;

where, at each strap attachment location, the webbing passes through the slots and passes alternately over and under the tongues at that location, in such a manner that a portion of the length of the webbing lies tightly flat against the top surface of one tongue, and another portion of the length lies tightly flat against the bottom surface of another tongue at that location;

and where each slot is open to an edge of the shelf in such a manner that webbing is insertable into and removable from the slot in a direction in the plane of the shelf.

2. Shelf assembly of claim 1, where the slots are disposed with their length parallel to the length of the shelf.

3. Shelf assembly of claim 2, where some of the slots are open to the side edges of the shelf;

where the tongues are of simple rectangular shape, the ends of the tongues being contiguous with the side edge of the shelf;

and where the slots are sufficiently long that the full width of the webbing is accommodated within the slot.

4. Shelf assembly of claim 2, where some of the slots are included as the bars of T-slots, the stems of the T-slots being open to one of the edges of the shelf that lies at right angles to the side edges of the shelf, and where the webbing is accommodated within the slot.

5. Shelf assembly of claim 1, where two top-straps are provided;

where the slots in the upper shelf are wide enough to accommodate two thicknesses of webbing;

where one shelf-strap and one top-strap are accommodated and lie in face-to-face contact with each other within the slots at one shelf attachment location;

and where the top-straps are attached to respective fixing points on a wall or ceiling.

6. Shelf assembly of claim 1, where three of the said shelves and four of the said shelf-straps are provided;

where the shelves are arranged one above the other;

where the slots in the middle shelf are wide enough to accommodate two thicknesses of webbing;

where two shelf-straps are accommodated together and lie in face-to-face contact with each other within the slots at one shelf attachment location in the middle shelf;

and where one of the said two shelf-straps extends upwards to the shelf above, and the other of the two extends downwards to the shelf below.

* * * * *